US005643040A

United States Patent [19]

Hippely et al.

[11] Patent Number: 5,643,040

[45] Date of Patent: Jul. 1, 1997

[54] TOY VEHICLE PLAYSET HAVING VEHICLE RECEIVING AND HOLDING STATION

[75] Inventors: Keith A. Hippely, Manhattan Beach; Larry R. Wood, Redondo Beach; Brian E. Walsh, Mission Hills; Terence A. Choy, Lawndale, all of Calif.

[73] Assignee: Mattel, Inc., El Segundo, Calif.

[21] Appl. No.: 387,049

[22] Filed: Feb. 10, 1995

[51] Int. Cl.[6] ..... A63H 29/00; A63H 17/44; A63H 18/00

[52] U.S. Cl. ..... 446/429; 446/423; 446/424; 446/444

[58] Field of Search ..... 446/423, 424, 446/429, 431, 435, 437, 440, 441, 444, 445

[56] References Cited

U.S. PATENT DOCUMENTS

| | | | |
|---|---|---|---|
| 3,011,288 | 12/1961 | Einfalt . | |
| 3,117,395 | 1/1964 | Einfalt | 446/435 X |
| 3,457,668 | 7/1969 | Genin | 446/423 |
| 3,545,757 | 12/1970 | Tepper et al. . | |
| 3,600,849 | 8/1971 | Faller | 446/429 |
| 3,670,450 | 6/1972 | Morosawa | 446/424 |
| 3,717,346 | 2/1973 | Merino et al. . | |
| 4,045,908 | 9/1977 | Ensmann et al. | 446/444 X |
| 4,108,437 | 8/1978 | De Anda et al. . | |
| 4,423,871 | 1/1984 | Murcaro . | |
| 4,425,735 | 1/1984 | Kulesza et al. | 446/444 X |
| 4,472,906 | 9/1984 | Cook et al. . | |
| 4,498,886 | 2/1985 | Goldfarb et al. | 446/429 X |
| 4,582,500 | 4/1986 | Hanson et al. | 446/423 |

FOREIGN PATENT DOCUMENTS

| | | | |
|---|---|---|---|
| 1369134 | 10/1974 | United Kingdom | 446/444 |

*Primary Examiner*—Robert A. Hafer
*Assistant Examiner*—D. Neal Muir
*Attorney, Agent, or Firm*—Roy A. Ekstrand

[57] ABSTRACT

A toy vehicle playset includes a trackway having a vehicle launcher coupled to a looped track portion and a dual tank unit positioned within the travel path of the toy vehicle through the trackway. The trackway further includes an exit ramp on the opposite side of the dual tank unit from the track loop which is coupled to a toy vehicle catcher and a display area. The dual tank unit includes a pair of tank portions separated by an intervening wall. The dual tank unit is supported within the trackway travel path such that either tank portion is alternatively positionable within the travel path of the toy vehicle. The playset further includes a multiply articulated robot arm supporting one or more thermally conductive tools or stamps which are immersible within the proximate one of the dual water tanks and appliable to the surface of the toy vehicle when resting in the toy vehicle catcher. The toy vehicle when launched down the trackway traverses the track loop and passes through the aligned one of the tank portions of the dual tank unit to receive a hot or cold water bath. The toy vehicle is at least partially covered with a thermochromic paint or coating and undergoes a thermochromic appearance change in the bath. Ideally, each of the tank portions is filled with a different temperature water supply.

7 Claims, 3 Drawing Sheets

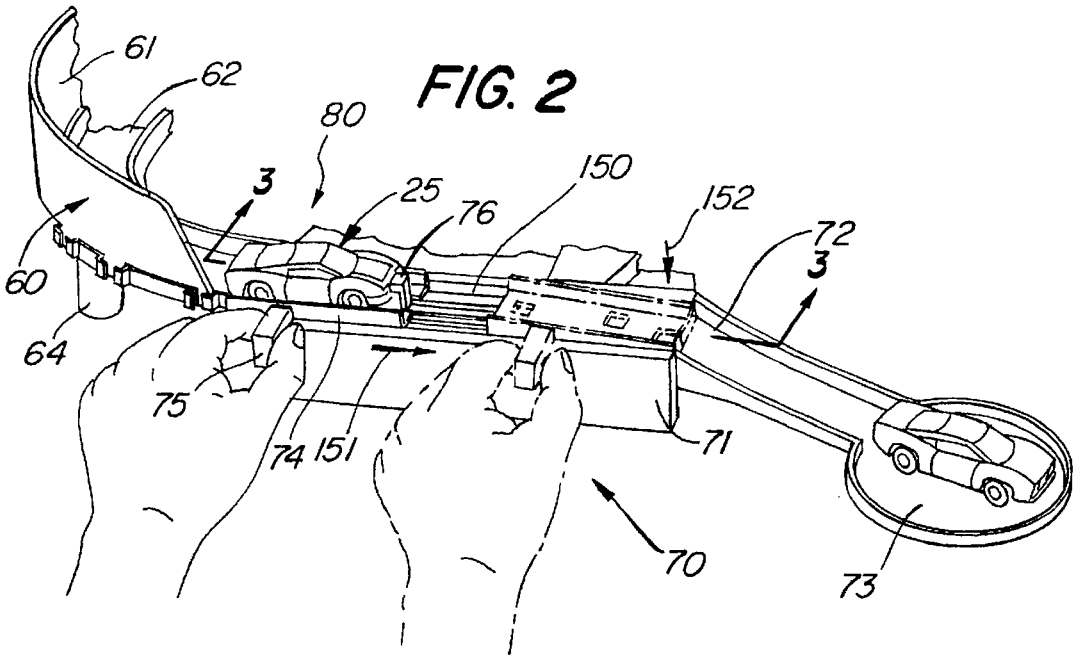
FIG. 2
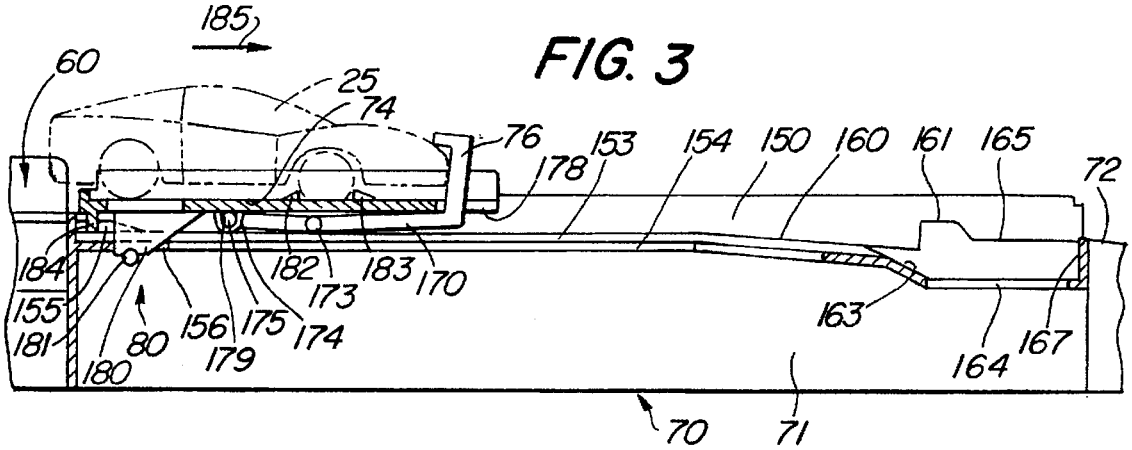
FIG. 3
FIG. 4
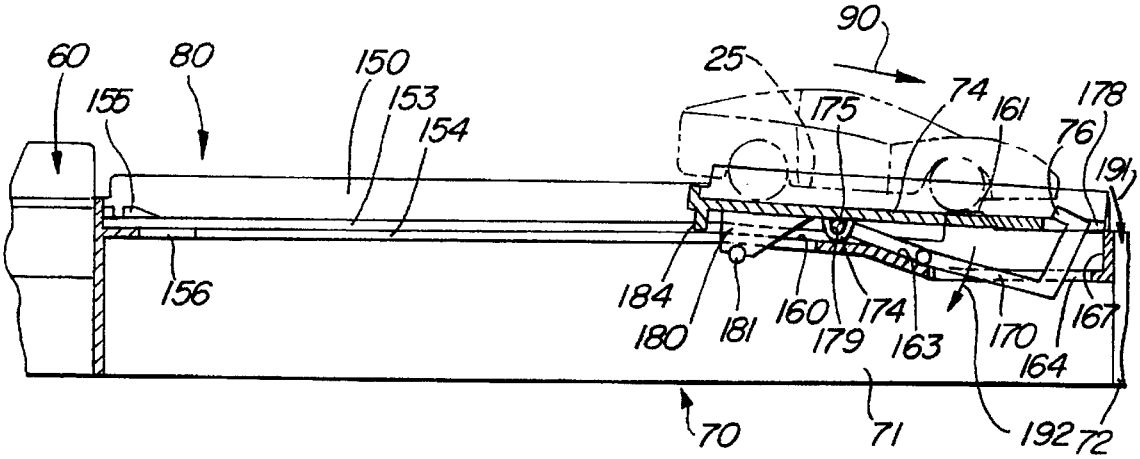

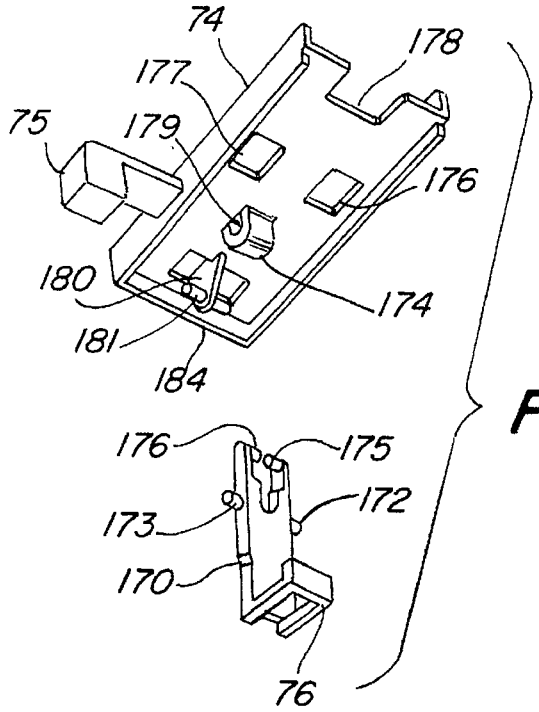
FIG. 5
FIG. 6
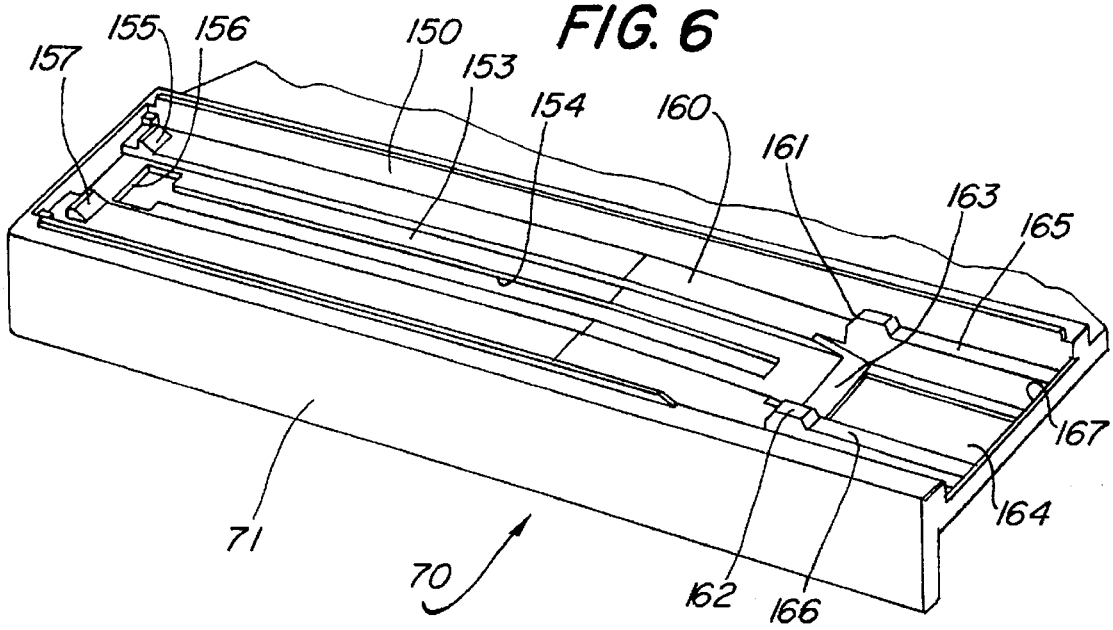

TOY VEHICLE PLAYSET HAVING VEHICLE RECEIVING AND HOLDING STATION

CROSS-REFERENCE TO RELATED APPLICATIONS

This application discloses apparatus described and claimed in copending application Ser. No. 08/387,047 (Attorney Docket 13600(2)) filed Feb. 10, 1995 on behalf of Hippely, et al. and entitled THERMOCHROMIC TOY VEHICLE PLAYSET HAVING ROBOT ARM DETAILER and copending application Ser. No. 08/388,224 (Attorney Docket 13600(1)) filed Feb. 9, 1995 on behalf of Hippely, et al. and entitled TOY VEHICLE PLAYSET FOR THERMOCHROMIC VEHICLES which are assigned to the assignee of the present application.

FIELD OF THE INVENTION

This invention relates generally to toy vehicle playsets and particularly to those using thermochromic or color change toy vehicles.

BACKGROUND OF THE INVENTION

Toy vehicle playsets have proven to be an extremely enduring and popular category of toys for a great many years. Not surprisingly, this long lasting and extensive popularity has given rise to a virtually endless variety of toy vehicle playsets. Thus, such playsets have been provided which use simple track structures and equally simple hand-rolled toy vehicles as well as more complex track structures utilizing toy vehicles which are powered or launched through the track playset. For example, a variety of toy vehicle playsets utilize a track having an elevated launching portion employing gravity and its effect upon the toy vehicle to provide a launching energy to traverse the track set. Other toy vehicle playsets have used spring-loaded or spring-powered launchers to provide the initial energy required to drive the toy vehicle through the track set. Still other toy vehicle playsets have utilized vehicles which themselves are powered using devices such as inertial drive motors, spring-driven wind-up motors, or electrical motors having battery or other electrical power sources. The variation has included a substantial divergence of the track structures themselves. The simpler track structures utilize a simple oval racetrack while others employ more complex apparatus such as inverting loop segments or jump and landing ramp segments which hurtle the toy vehicles through the air across an intervening gap.

Just as the track playsets have been subject to variation, the toy vehicles themselves have been similarly varied and diverse. Such toy vehicles are often realistic, bright colored and finely detailed. Others are less detailed, more fanciful and cartoon-like in character. Still other toy vehicles used in such playsets are configurable in alternative element arrangements to vary their appearance. One of the more interesting toy vehicle variations produced through the years employs so-called thermochromic material which forms paint or coating upon the toy vehicles and which provides a change in color in response to temperature changes. Such toy vehicles often referred to "color-change" toy vehicles have provided an interesting and amusing variation for toy designers to utilize in their endless task of providing amusing and entertaining as well as novel toy playsets.

Thus, practitioners continue to respond to the popularity of such toy vehicle playsets to improve the amusement, entertainment and novelty thereof.

For example, U.S. Pat. No. 3,545,757 issued to Tepper sets forth a RACING TOY HAVING VEHICLE PROPELLING AND ARRESTING MEANS in which two side by side tracks support rollable vehicles each of which moves around the entire track as a result of force applied to it during its movement along a propulsion region. A vehicle driving member is located beneath and moves along each propulsion region in response to movement of a handle operated by a player. The driving member carries a means, for example a pawl, for engaging and moving a vehicle on the track propulsion region. The driving member also carries a means such as an abutment for arresting or slowing the movement of the vehicle which moves onto the track propulsion region.

U.S. Pat. No. 4,472,906 issued to Cook, et al. sets forth a MANUALLY ACTIVATED TOY VEHICLE LAUNCHER having an upper casing unit slidable in a rectilinear direction relative to a lower casing unit. Rubber feet on the lower unit frictionally engage the playing surface onto which the toy vehicle is launched. The vehicle is acted upon a ram having a gear rack in mesh with a relatively large circular gear. Two relatively small circular gears are in mesh with a gear rack on the lower casing unit. Manual actuation of the upper casing unit in one axial direction relative to the lower casing unit causes the ram to push the toy vehicle and launch it.

U.S. Pat. No. 4,423,871 issued to Mucaro sets forth a TOY VEHICLE GAME having a track, a toy vehicle and a launcher for launching the toy vehicle along the track. The track includes a start position at which the launcher is located and an end position located above the start position.

U.S. Pat. No. 4,108,437 issued to DeAnda, et al. sets forth a TOY VEHICLE STARTING AND LAUNCHING SET having a pair of parallel toy vehicle tracks and a pair of parallel toy vehicle launchers. A timer is provided and a pair of triggers operate the launchers in response to the time completing its timed interval.

U.S. Pat. No. 3,717,346 issued to Merino, et al. sets forth a TOY VEHICLE STARTING MECHANISM for use with self-powered miniature toy vehicles. The starting mechanism is operative for playsets having two vehicle paths and includes a sliding support frame having projecting switch abutments to engage activating switches of the toy vehicles.

U.S. Pat. No. 3,011,288 issued to Einfalt sets forth a TOY TRACK FOR VEHICLES having a multiply curved track formed on a play board and cooperating spring-powered wind-up toy vehicles.

While the foregoing described prior art devices have improved the art and in some instances enjoyed commercial success, there remains nonetheless a continuing need in the art for evermore improved, interesting and amusing toy vehicle playsets.

SUMMARY OF THE INVENTION

Accordingly, it is a general object of the present invention to provide an improved toy vehicle playset. It is a more particular object of the present invention to provide an improved toy vehicle playset having a vehicle receiving station which captivates and holds a toy vehicle within the vehicle trackway.

In accordance with the present invention, there is provided for use in combination with a toy vehicle, a toy vehicle playset comprising: a trackway for guiding a toy vehicle along a travel path and having an end portion; a housing coupled to the end portion of the trackway; a shuttle slidable upon the housing between a receiving position proximate the end portion of the trackway and a discharge position; and a toy vehicle stop means operative when the shuttle is in the receiving position for retaining a toy vehicle upon the shuttle and for releasing a retained toy vehicle from the shuttle when the shuttle is moved to the discharge position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 2 sets forth a partial perspective view of the toy vehicle receiving and holding station of the present invention;

FIG. 3 sets forth a section view of the present invention toy vehicle receiving and holding section taken along section lines 3—3 in FIG. 2;

FIG. 4 sets forth a section view of the present invention toy vehicle receiving and holding section taken along section lines 3—3 in FIG. 2 showing the vehicle receiving and holding station in the release position;

FIG. 5 sets forth a partial assembly view of the shuttle and stop mechanism of the present invention; and FIG. 6 sets forth a perspective view of the support housing for the present invention toy vehicle receiving and holding station.

DESCRIPTION OF THE PREFERRED EMBODIMENT

Figure 1:
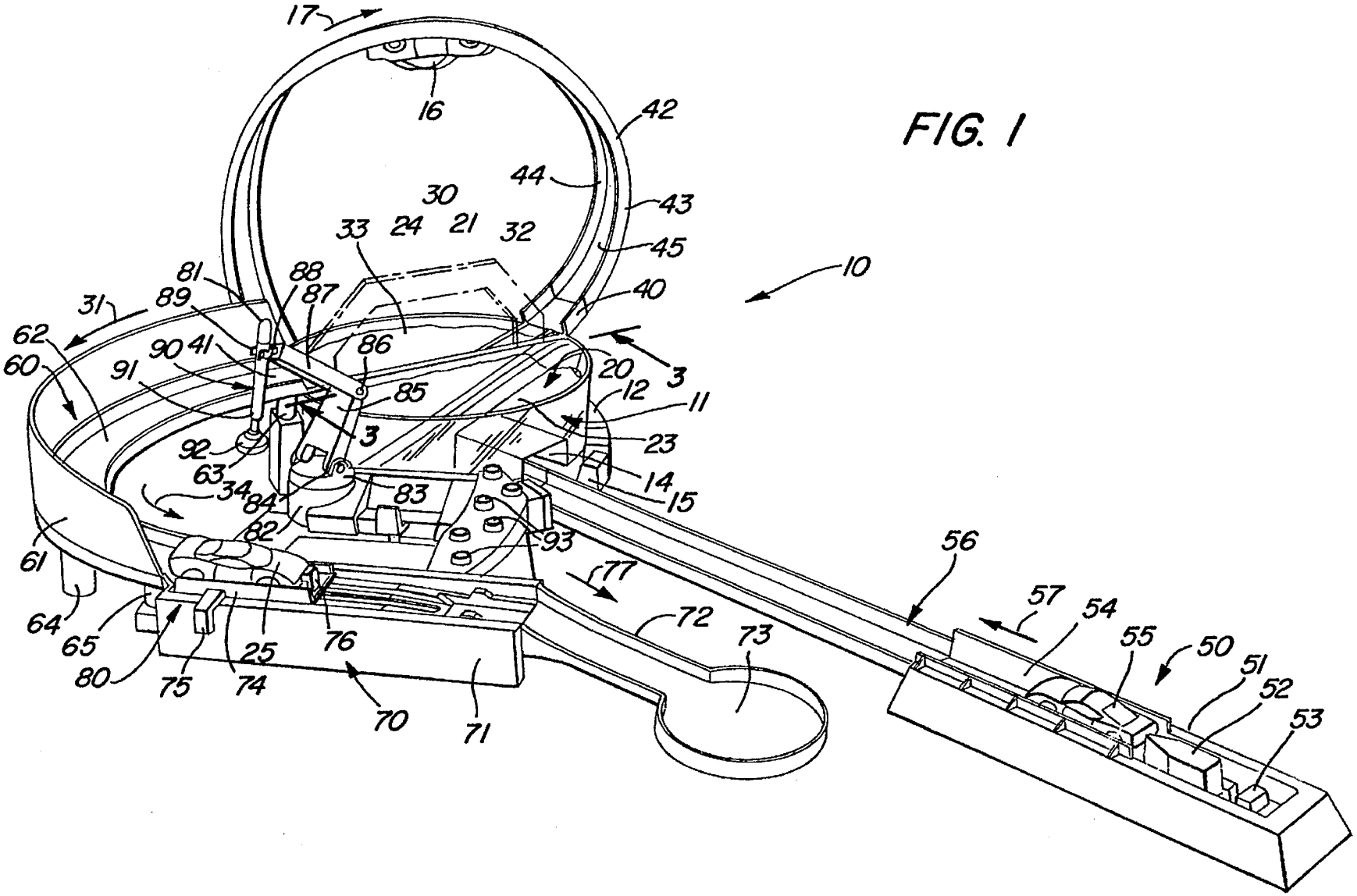
FIG. 1 sets forth a perspective view of a toy vehicle playset constructed in accordance with the present invention.

FIG. 1 sets forth a perspective view of a toy vehicle playset constructed in accordance with the present invention and generally referenced by numeral 10. Playset 10 includes a dual tank unit 11 supported by a base 12 and having a pair of tank portions 20 and 30 separated by a wall 21. Base 12 further defines an opening 15 which is coupled to and receives a straight track segment 56. A vehicle launcher 50 constructed in accordance with conventional fabrication techniques is coupled to track segment 56 and includes a housing 51 supporting a movable spring-loaded pusher 52 and a trigger latch 53. Vehicle launcher 50 further includes a staging area 51 which is shown receiving a vehicle 55 in the to-be-launched position.

Base 12 further supports an entrance gate 40 and an exit gate 41 in alignment on a common side of wall 21 of dual tank unit 11. A track loop 42 having a pair of sidewalls 43 and 44 on each side of a trackway 45 is coupled at one end to entrance gate 40 and forms a vertical loop extending downwardly into alignment with track segment 56 on the opposite side of opening 15 in base 12. Tank 20 defines a dipped ramp 22 alongside one side of wall 21 while tank 30 defines a similar dipped ramp 32 on the opposite side of wall 21. Tanks 20 and 30 support quantities of water 23 and 33 respectively which in accordance with the present invention differ substantially in temperature. Dual tank unit 11 further includes an upwardly extending handle 24 and a tunnel 14 which extends beneath tanks 20 and 30 and emerges on the opposite side of the dual tank unit in alignment with the remaining end of track loop 42.

Playset 10 further includes a curved ramp 60 having a raised outer sidewall 61 and a trackway 62. Trackway 62 extends from exit gate 41 in a downwardly curved path. Ramp 60 is supported by a plurality of supports 63, 64 and 65. Playset 10 further includes a toy vehicle catcher 70 having an elongated housing 71 which receives and supports a movable shuttle 74. Shuttle 74 includes a tab 75 extending outwardly therefrom and a vehicle stop mechanism 76 at the frontal portion thereof. Toy vehicle catcher 70 further includes a downwardly extending ramp 72 terminating in a display area 73. In the position shown in FIG. 1, shuttle 74 has received and captured a toy vehicle 25 following the toy vehicle's travel down trackway 62. This position shown in FIG. 1 provides a vehicle detail area 80 in which the toy vehicle may be further enhanced in its appearance.

Toy vehicle playset 10 further includes a robot arm 81 having a support base 82 upon which a rotatable platform 83 is secured. Platform 83 includes a pivot 84 securing a support arm 85 at the lower end thereof. An arm 87 is pivotally coupled to the upper end of arm 85 by a pivotal attachment 86. A swivel joint 88 supports a clasp 89 in a pivotal attachment at the upper end of arm 87. A stamp 90 includes an elongated handle 91 received within clasp 89 supporting a thermally conductive stamper 92 at the lower end thereof. Stamper 92 is preferably formed of a thermally conductive material and defines an embossed design producing member. Toy vehicle catcher 70 further defines a plurality of tool receptacles 93 which receive and support a plurality of alternative tools generally configured in the manner shown for stamp 90 and having elongated handles such as handle 91 which are receivable within receptacles 93 for convenient access and storage.

In operation, dual tank unit 11 is initially filled with quantities of water 23 and 33 within tanks 20 and 30 having substantial temperature differences. Thus, for example, tank 20 may be filled with hot water while tank 30 is filled with cold water. Dual tank unit 11 is positioned such that tunnel 14 is aligned with opening 15 of base 12 and track segment 56. Thereafter, a toy vehicle such as vehicle 55 is placed within launcher 50 which in turn is cocked to permit the launching of vehicle 50. In the preferred play pattern of the present invention, vehicle 55 comprises a toy vehicle having at least certain portions coated or painted with a color change or thermochromic material. In the present example, water 23 within tank 20 is hot while water 33 within tank 30 is cold. Accordingly, the preferred effect of the present invention playset is provided if vehicle 55 is subjected to a hot water bath and dried prior to placement within vehicle launcher 50. This is because the position of dual tank unit 11 in the present example of FIG. 1 aligns tank 30 having cold water therein with track loop 42 and ramp 60.

With vehicle 55 thus configured and positioned within vehicle launcher 50, the user then pushes trigger 53 causing vehicle 55 to be launched in the direction of arrow 57 from launcher 50 in a conventional vehicle launching operation. Vehicle 55 then travels in the direction of arrow 57 through track segment 56 and opening 15 into tunnel 14. The toy vehicle continues through tunnel 14 emerging on the opposite side of dual tank unit 11 and traveling beneath tanks 20 and 30 to enter the lower end of track loop 42. Thereafter, the kinetic energy of the toy vehicle causes it to traverse track loop 42 in the direction indicated by arrow 17. For purposes of illustration, a toy vehicle 16 is shown at the midpoint of traversing track loop 42. The toy vehicle then continues traveling downwardly upon the remaining portion of track loop 42 through entrance gate 40 and into tank 30. As the toy vehicle traverses ramp 32 through tank 30, it is subjected to the cold water within tank 30 and undergoes a temperature change. The kinetic energy of the toy vehicle carries it upwardly upon the remaining portion of ramp 32 through exit gate 41 and onto trackway 62 of ramp 60 in the direction indicated by arrow 31. In the example of FIG. 1, the toy vehicle when subjected to the cold water within tank 30 undergoes a sufficient temperature change to change the thermochromic coating material thereof and produce a color change. The color change vehicle traverses trackway 62 and enters shuttle 74 of toy vehicle catcher 70. The travel of the toy vehicle is stopped in the position shown by vehicle 25 through the action of stop 76.

The color changed toy vehicle now resting within shuttle 74 has assumed the color change configuration which results from cold water immersion within tank 30. At this point, the toy vehicle may be further enhanced or detailed through the use of robot arm 81 while supported within detail area 80 as shown in FIG. 1. Robot arm 81 is pivotally movable about base 82 as platform 83 rotates. In its preferred use, robot arm 81 is pivoted to extend arm 87 above tank 20 and permit stamper 92 of stamp 90 to be immersed into the hot water within tank 20 by suitable pivoting swivel joint 88, pivot 86, and pivot 84. Stamper 92 is warmed within the hot water of tank 20 and thereafter is withdrawn from water 23 by manipulation of robot arm 81. Robot arm 81 is further manipulated to position stamper 92 of stamp 90 in proximity to vehicle 25 and thereafter bring stamper 92 against a selected area of vehicle 25. As mentioned above, vehicle 25 having traversed the cold water bath of tank 30 has assumed the thermochromic characteristic of lower temperature. The warming action of stamper 92 against the cold temperature configurated vehicle causes a localized thermochromic characteristic change on the portions of vehicle 25 contacted by stamper 92 due to its warm temperature received from the warm water of tank 20. Robot arm 81 is thereafter manipulated to move stamper 92 away from toy vehicle 25 with the result that vehicle 25 now has a thermochromically imparted image corresponding to stamper 92. This process may be repeated with robot arm 81 moving stamper 92 between the hot water of tank 20 and the cold temperature configured surface of vehicle 25. If desired, a small tissue paper or absorbent material may be used to blot the warm water from stamper 92 following its immersion within tank 20.

Once the desired images have been formed upon vehicle 25, the user then moves vehicle 25 by sliding tab 75 toward ramp 72 across toy vehicle catcher 70. Once shuttle 74 reaches ramp 72, stop 76 is released and the toy vehicle is moved onto ramp 72 and descends downwardly into display area 73 where it remains until removed by the user.

Dual tank unit 11 is reversible in its position by simply raising dual tank unit 11 slightly while grasping handle 24 and thereafter rotating dual tank unit 11 one hundred eighty degrees and then lowering dual tank unit 11 back into the seated position upon base 12. The reversal or one hundred eighty degree rotation of dual tank unit 11 switches the relative positions of tanks 20 and 30 from that shown in FIG. 1. As a result of such rotation or tank switching, the travel path of the toy vehicle passes through the hot water of tank 20 while the cold water of tank 30 is positioned in proximity to robot arm 81. Thus, the relative positions of tanks 20 and 30 and robot arm 81 assure that robot arm 81 is always subjecting the stamp or tool which it supports to a temperature opposite from that to which the toy vehicle has been most recently exposed as it travels the trackway and comes to rest in detail area 80.

FIG. 2 sets forth a partial perspective view of a toy vehicle receiving and holding station constructed in accordance with the present invention and generally referenced by numeral 70. Toy vehicle catcher 70 provides a toy vehicle receiving and holding station coupled to the remainder of the present invention toy vehicle playset by a curved ramp 60 having a trackway 62 and a curved wall 61 supported by a plurality of supports such as support 64. Toy vehicle catcher 70 includes an elongated generally rectangular housing 71 defining an elongated channel 150 extending across the upper surface thereof. The structure of housing 71 is set forth below in FIG. 6 in greater detail. However, suffice it to note here that channel 150 forms a rectangular channel extending from the end of trackway 62 of curved ramp 60 and ramp 72 coupled to the opposite end of housing 71. Ramp 72 extends downwardly and terminates in a circular walled vehicle display area 73. A vehicle shuttle 74 is slidably movable within channel 150 and in accordance with the apparatus set forth below in greater detail supports a raised vehicle stop 76 at the forward end thereof. Shuttle 74 further includes an outwardly extending tab 75.

In the position shown in FIG. 2, a toy vehicle 25 is received and held within shuttle 74 of toy vehicle catcher 70 by stop 76. The position of shuttle 74 maintaining toy vehicle 25 as shown in solid-line representation defines a vehicle detail area generally referenced by numeral 80.

Once the above-described detailing of vehicle 25 is complete, the user is then able to move shuttle 74 toward ramp 72 in the direction of arrow 151 by grasping tab 75 and sliding shuttle 74 within channel 150. As shuttle 74 moves, it carries vehicle 25 with it until the shuttle reaches the end of channel 150 to the position shown in dashed-line representation in FIG. 2. Thereafter, the release mechanism set forth below in FIGS. 3 and 4 in greater detail is operative upon shuttle 74 and withdraws stop 76 beneath shuttle 74 while simultaneously pivoting shuttle 74 in the direction indicated by arrow 152. Once stop 76 has been drawn downwardly and shuttle 74 is pivoted, the toy vehicle supported therein rolls down ramp 72 and is captured within display area 73.

Thus, in the anticipated operation of the present invention toy vehicle receiving and holding station, the toy vehicle is accelerated through the toy vehicle trackset and through one side of dual tank unit 11 (seen in FIG. 1) emerging therefrom upon trackway 62. Thereafter, the toy vehicle continues and is guided by trackway 62 to shuttle 74. Upon arriving at shuttle 74, stop 76 being in the raised position precludes further travel of the vehicle stopping the vehicle within shuttle 74 in the position shown by vehicle 25 in FIG. 2. Once the above-described detailing process is continued, the user grasps tab 75 sliding shuttle 74 in the direction of arrow 151 to the dashed-line position performing the tilting and release process and transferring the toy vehicle to display area 73 via ramp 72. In accordance with an important aspect of the present invention, the entire operation of toy vehicle catcher 70 is provided by the user's simple manipulation of tab 75. Thus, the transfer of the toy vehicle from detail area 80 to display area 73 is performed with a simple sliding motion of tab 75. As a result, the present invention toy playset is operable by even the youngest of children.

FIGS. 3 and 4 set forth section views of toy vehicle catcher 70 in alternative positions during the above-described cycle of shuttle 74 motion. FIG. 3 depicts toy vehicle catcher 70 holding a toy vehicle in the detail area in the manner shown in FIG. 2 facilitating the above-described detailing or image embossing of the toy vehicle. FIG. 4, however, shows the position of shuttle 74 and a toy vehicle supported thereon as shuttle 74 is moved forwardly to the dashed-line position shown in FIG. 2 whereby the toy vehicle supported upon the shuttle is released from the shuttle and directed to ramp 72 for transfer to display area 73 (seen in FIG. 2).

More specifically, FIG. 3 sets forth a section view of toy vehicle catcher 70 taken along section lines 3—3. As mentioned, shuttle 74 is positioned in the position shown in FIG. 2 in which vehicle 25 is maintained in a detail area 80. Toy vehicle catcher 70 includes an elongated housing 71 defining a center channel 150 within which an elongated recessed trough 153 extends. A center slot 154 extends through a substantial portion of trough 153. Channel 150 includes an incline 160 and an angled facet 163. A pair of risers 161 and 162 (the latter seen in FIG. 6) are formed on each side of angled facet 163 and aperture 164. In addition, a shuttle rest surface 165 and a shuttle rest surface 166 (seen in FIG. 6) extends between risers 161 and 162 respectively and end wall 167 of housing 71. Ramp 72 is coupled to the end portion of housing 71. An aperture 156 is formed within trough 153 at the frontal end of housing 71. A pair of wedge-shaped stop members 155 and 157 are positioned on each side of aperture 156 as is better seen in FIG. 6. The frontal end of housing 71 is coupled to a ramp 60 in the manner better seen in FIG. 1.

A movable shuttle 74 defining a generally U-shaped member defines a frontal notch 78 and a downwardly extending tab 180. Tab 180 extends through aperture 156 and supports a transversely extending cylindrical rod 181. Rod 181 is greater in length than the width of slot 154 but less in length than the transverse dimension of aperture 156. Shuttle 74 further includes a downwardly extending sleeve 174 defining a passage 179 therein. An elongated stop arm 170 supports an upwardly extending stop 76 at one end and a pair of posts 175 and 176 (the latter seen in FIG. 5) at the opposite end. Posts 175 and 176 are received within passage 179 of sleeve 174 to provide a pivotal attachment between stop arm 170 and the underside of shuttle 174. Stop arm 170 further includes a pair of outwardly extending posts 172 and 173 (the former seen in FIG. 5) which extend outwardly beyond trough 153 and rest upon the bottom surface of channel 150. Shuttle 74 further includes a downwardly extending rib 184.

In operation, shuttle 74 is initially positioned as shown in FIG. 3 at the frontal end of toy vehicle catcher 70 such that rib 84 is received against stops 155 and 157 (the latter seen in FIG. 6). As a result, shuttle 74 is maintained and precluded from movement within channel 150. In addition, the extension of posts 172 and 173 (the former seen in FIG. 5) beyond trough 153 maintains arms 170 in a generally horizontal position beneath shuttle 74 such that stop 76 extends upwardly through notch 178. Tab 180 extends through aperture 156 and rod 181 extends transversely beneath aperture 156. At this point, shuttle 74 is secured in the position shown within detail area 80 and awaits the arrival of a toy vehicle such as vehicle 25 shown in dashed-line representation. As toy vehicle 25 approaches toy vehicle catcher 70 via ramp 60 in the manner described above, the toy vehicle rolls upon shuttle 74 and is captured by the combined action of stop 76 as well as the intrusion of the vehicle wheels into apertures 176 and 177 (seen in FIG. 5) formed within shuttle 74. In addition, apertures 176 and 177 are bounded on their frontal and rear edges by raised wedge portions such as wedges 182 and 183 formed on the front and back of aperture 176.

Thus, toy vehicle 25 is captured by shuttle 74 and the kinetic energy thereof is absorbed to maintain the toy vehicle in the detail area. Once the detail activities have been completed, the user transfers the toy vehicle from the detail area to the display area by moving shuttle 74 in the direction indicated by arrow 185. In this motion, the maintaining force of rib 184 against stops 155 and 157 must be overcome afterwhich shuttle 74 is free to travel. As shuttle 74 moves in the direction of arrow 185, tab 180 extends through slot 154 and rod 181 secures the rear portion of shuttle 74 due to its extension beyond slot 154. Also, during the initial travel of shuttle 74, posts 172 and 173 (the former seen in FIG. 5) continue to ride upon the lower surface of channel 150 thereby maintaining stop 76 in its raised position. This motion in the direction of arrow 185 continues until shuttle 74 reaches the end of its travel and toy vehicle catcher 70 assumes the configuration shown in FIG. 4.

FIG. 4 sets forth the section view of toy vehicle catcher 70 taken along section lines 3—3 in FIG. 2 at the end of the above-described shuttle motion. Thus, as shuttle 74 approaches incline 160, posts 172 and 173 (the former seen in FIG. 5) move downwardly upon incline 160 slightly lowering stop 176 through notch 178. As posts 172 and 173 reach angled face 163, stop arm 170 pivots downwardly in the direction indicated by arrow 192 to allow the forward end of stop arm 170 and stop 76 to descend through aperture 164 of housing 71. Concurrently, shuttle 74 moves to the end position in which it contacts wall 167 and in which risers 161 and 162 (the latter seen in FIG. 6) are received within apertures 176 and 177 of shuttle 74 (seen in FIG. 5). The purpose of risers 161 and 162 is to support the front wheels of vehicle 25 above apertures 176 and 177 such that the apertures no longer restrain the toy vehicle. In addition, the downwardly angled surfaces of incline 160 allow shuttle 74 to pivot downwardly in the direction indicated by arrow 191 which provides a slight gravity action force upon vehicle 25 in the direction of arrow 190 sufficient to cause vehicle 25 to roll downwardly from shuttle 74 to ramp 72.

Thus, the toy vehicle is easily transferred from detail area 80 to ramp 72 by the simple sliding motion of shuttle 74. Once the toy vehicle has been released from shuttle 74, the user simply slides shuttle 74 backwardly toward detail area 80 and locks it in the position of FIG. 3 to receive the next toy vehicle.

FIG. 5 sets forth a bottom perspective assembly view of shuttle 74 and stop arm 170. As described above, shuttle 74 defines a pair of wheel apertures 176 and 177 and a frontal notch 178. A tab 75 extends outwardly from the side of shuttle 74 while a sleeve 174 defining a passage 179 extends downwardly from the undersurface of shuttle 74. In addition, shuttle 74 defines a rear rib 184 and a downwardly extending tab 180. The latter further supports a transversely extending cylindrical rod 181. Stop arm 170 includes an upwardly extending stop member 76 and a pair of inwardly extending posts 175 and 176. Stop arm 170 further includes a pair of intermediate outwardly extending posts 172 and 173.

Stop arm 170 is assembled to shuttle 74 by forcing posts 175 and 176 outwardly a sufficient distance to allow assembly to sleeve 174 and thereafter releasing the post supports to permit posts 175 and 176 to be captivated within passage 179. When so assembled, stop arm 170 extends forwardly along the undersurface of shuttle 74 positioning stop 76 to extend upwardly through notch 178. The attachment of posts 175 and 176 to sleeve 174 provides a freely movable pivotal joint easily movable under its own weight.

FIG. 6 sets forth a partial perspective view of housing 71 of toy vehicle catcher 70. As described above, housing 71 defines a channel 150 having a recessed trough 153 and an elongated slot 154 formed therein. Slot 154 terminates at its forwardmost end in an enlarged aperture 156. A pair of wedge-shaped stop members 155 and 157 are positioned on either side of aperture 156. Channel 150 further defines an incline 160 and an angled facet 163. A pair of risers 161 and 162 are positioned on either side of facet 163 and a pair of horizontal shuttle rest surfaces 165 and 166 extend from risers 161 and 162 to an end wall 167. An aperture 164 is formed between shuttle rests 165 and 166.

With simultaneous reference to FIGS. 5 and 6, toy vehicle catcher 70 is assembled by initially assembling stop arm 170 to shuttle 74 in the manner described above. Thereafter, the combined subassembly of shuttle 74 and stop arm 170 is positioned above channel 150 of housing 71 such that tab 180 and rod 181 extend downwardly through aperture 156 and shuttle 74 rests within channel 150. When so positioned, rib 184 is captivated by stops 155 and 157 of housing 171. At this point, the shuttle is completely assembled and the toy vehicle catcher is ready for use.

What has been shown is a toy vehicle playset having a vehicle receiving and holding station which receives the traveling vehicle and maintains and holds the vehicle within a detail area for interactive play by the user. The vehicle receiving and holding station facilitates the transfer of the toy vehicle to a display area through a single action movement of a sliding tab easily manipulated by even the youngest of children. The entire assembly is readily formed of a trio of low cost molded components providing an easy to manufacture and inexpensive play accessory for a toy vehicle playset.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a free-wheeling nonpowered toy vehicle, a toy vehicle playset comprising:

a trackway for guiding said toy vehicle forwardly along a travel path in a travel direction and having an end portion;

a housing coupled to said end portion of said trackway defining a receiving position proximate said end portion and a discharge position spaced from said receiving position;

a shuttle slidable and displaceable upon said housing in a forward direction in said travel direction between a generally horizontal orientation at said receiving position proximate said end portion of said trackway and a downwardly inclined orientation at said discharge position; and a toy vehicle stop means operative when said shuttle is in said receiving position for retaining a toy vehicle upon said shuttle and for releasing a retained toy vehicle from said shuttle when said shuttle is moved to said discharge position to allow said toy vehicle to roll from said shuttle as it tilts.

2. A toy vehicle playset as set forth in claim 1 wherein said housing defines a channel and wherein said shuttle is received within said channel.

3. A toy vehicle playset as set forth in claim 2 wherein said toy vehicle stop means includes an elongated arm pivotally coupled to said shuttle at one end and having an upwardly extending stop member at the remaining end and means for raising said stop member when said shuttle is in said receiving position and lowering it when said shuttle is in said discharge position.

4. A toy vehicle playset as set forth in claim 3 wherein said shuttle defines an undersurface and a notch and wherein said elongated arm is pivotally coupled to said undersurface such that said stop member extends upwardly through said notch.

5. A toy vehicle playset as set forth in claim 4 wherein said shuttle defines a pair of wheel receiving apertures and wherein said housing defines a pair of risers at said discharge position, said risers extending through said wheel receiving apertures to raise toy vehicle wheels from said apertures at said discharge position.

6. A toy vehicle playset having a trackway for guiding a free-wheeling nonpowered toy vehicle, said toy vehicle playset comprising:

a housing having a channel formed therein aligned with a portion of said trackway defining first and second spaced apart ends;

a shuttle, slidably supported within said channel, having a vehicle receiving surface; said shuttle being slidably movable and displaceable between a generally horizontal orientation at a receiving position proximate said first end and a downwardly angled orientation at a discharge position proximate said second end;

a vehicle stop member extending upwardly from said shuttle;

a stop arm pivotally coupled to said shuttle and supporting said stop member, said stop arm being pivotable between a first position raising said stop member and a second position lowering said stop member;

a stop arm guide surface formed within said channel for pivoting said stop arm to said first position when said shuttle is in said receiving position and to said second position when said shuttle is in said discharge position; and a horizontal surface formed in said channel for supporting said shuttle in said generally horizontal orientation at said receiving position and an angled surface formed within said channel for supporting said shuttle in said downwardly angled orientation at said discharge position.

7. A toy vehicle playset as set forth in claim 6 wherein said shuttle receiving surface defines a pair of apertures for receiving the front wheels of a toy vehicle and wherein said channel defines a pair of risers at said discharge position for lifting the toy vehicle front wheels from said apertures.

* * * * *